US009115969B2

(12) United States Patent
Goodwin et al.

(10) Patent No.: US 9,115,969 B2
(45) Date of Patent: Aug. 25, 2015

(54) MULTI-USE URGENT RESPONSE RESOURCE KIT

(71) Applicants: Philip R. Goodwin, Boerne, TX (US); Craig G. Bastarache, Austin, TX (US); Michael K. Andrews, Kyle, TX (US); Bryan B. Lin, Conway, AR (US)

(72) Inventors: Philip R. Goodwin, Boerne, TX (US); Craig G. Bastarache, Austin, TX (US); Michael K. Andrews, Kyle, TX (US); Bryan B. Lin, Conway, AR (US)

( * ) Notice: Subject to any disclaimer, the term of this patent is extended or adjusted under 35 U.S.C. 154(b) by 143 days.

(21) Appl. No.: 13/919,351

(22) Filed: Jun. 17, 2013

(65) Prior Publication Data

US 2013/0341210 A1 Dec. 26, 2013

Related U.S. Application Data

(60) Provisional application No. 61/662,183, filed on Jun. 20, 2012.

(51) Int. Cl.
*F42B 39/26* (2006.01)
*F42B 39/02* (2006.01)

(52) U.S. Cl.
CPC ..... *F42B 39/26* (2013.01); *F42B 39/02* (2013.01)

(58) Field of Classification Search
USPC ..... 224/309, 311, 314, 317–321, 323–325, 224/329
See application file for complete search history.

(56) References Cited

U.S. PATENT DOCUMENTS 4,466,659 A * 8/1984 Carpentier et al. ..... 297/188.06
4,650,103 A * 3/1987 Mitchell ..... 224/275
4,735,246 A * 4/1988 Niehaus ..... 206/6.1
4,773,535 A * 9/1988 Cook ..... 206/373
4,826,059 A * 5/1989 Bosch et al. ..... 224/183
4,953,765 A * 9/1990 Little et al. ..... 224/583
5,195,778 A * 3/1993 Dismuke ..... 280/770
5,460,305 A * 10/1995 Ahearn ..... 224/562
5,638,915 A * 6/1997 Hardy ..... 182/129
5,671,849 A * 9/1997 Bacon ..... 211/85.2
5,878,672 A * 3/1999 Ostermann et al. ..... 108/44
5,957,308 A * 9/1999 Zierenberg ..... 211/64
6,250,470 B1 * 6/2001 Mackenzie ..... 206/579
6,587,022 B1 * 7/2003 Devine ..... 335/285
6,763,986 B2 * 7/2004 Santos et al. ..... 224/585
6,874,667 B2 * 4/2005 Dykstra et al. ..... 224/498
7,073,672 B2 * 7/2006 Sholem ..... 211/70.6
7,891,733 B1 * 2/2011 Clarke ..... 297/188.06
8,118,201 B1 * 2/2012 Calkin ..... 224/156
8,292,094 B2 * 10/2012 Morton ..... 211/64
8,312,990 B2 * 11/2012 Gaspari et al. ..... 206/6.1
2002/0170934 A1 * 11/2002 Haspel ..... 224/311
2004/0182899 A1 * 9/2004 Deutchman ..... 224/410
2005/0230443 A1 * 10/2005 Bredeson ..... 224/275
2006/0000788 A1 * 1/2006 Sholem ..... 211/70.6
2006/0016841 A1 * 1/2006 Shurm ..... 224/222

(Continued)

*Primary Examiner* — Brian D Nash

(74) *Attorney, Agent, or Firm* — David O. Simmons

(57) ABSTRACT

In another embodiment of the present invention, an organizer assembly includes an article holding body and a mounting structure. The article holding body has a first body segment, a second body segment and a hinge segment connected between the first body segment and the second body segment. The first body segment, the second body segment and the hinge segment jointly define opposing major faces of the article holding body. An ammunition magazine holding structure, a shotgun shell holding structure, an article containment pocket and a canister holding structure are provided on a first one of the opposing major faces. The mounting structure is selectively attachable to and detachable from the first body segment at a second one of the opposing major faces.

18 Claims, 5 Drawing Sheets

(56) References Cited

U.S. PATENT DOCUMENTS

2006/0118376 A1* 6/2006 Godshaw et al. ..... 190/107
2008/0128305 A1* 6/2008 Guirlinger ..... 206/372
2012/0217276 A1* 8/2012 Kennedy ..... 224/400

* cited by examiner

MULTI-USE URGENT RESPONSE RESOURCE KIT

CROSS REFERENCE TO RELATED APPLICATIONS

This non-provisional patent application claims priority from U.S. provisional patent application having Ser. No. 61/662,183 filed Jun. 20, 2012 entitled "MURRK (Multi-Use Urgent Response Resource Kit)", having a common applicant herewith, and being incorporated herein in its entirety by reference.

FIELD OF THE DISCLOSURE

The disclosures made herein relate generally to organizers for discrete, disparate articles and, more particularly, to a multi-use organizer for articles typically used by a law enforcement officer in urgent response situations.

BACKGROUND

Law enforcement officers face numerous challenges on a daily basis. From active shooter situations to routine traffic stops, law enforcement professionals need different tools and materials for different situations. In an active shooter situation, law enforcement professionals need assault weapons, ammunition, and medical supplies with no delay. Even in events as common as a daily routine traffic stop, a law enforcement professional can find themselves in unexpected circumstances that require them to make split second decisions and have the resources associated with those decisions readily available to them.

To be prepared for the unexpected, these considerations require law enforcement professionals to be well organized not only on a personal scale, but also organized as a team. Presently, it is common for law enforcement professionals to use in-car organizers that are mounted at a passenger location on the front seat of their vehicle. An in-car organizer of this type is substandard for a variety of reasons. One such reason is that law enforcement is an equipment intensive job, meaning there are tools and/or forms for just about all activities in which a law enforcement professional engages. Because in-car organizers do not generally have specific locations for specific articles (e.g., ammunition, deterrent sprays, medical supplies, paperwork, etc), they become cluttered which limits fluency from officer to officer, may change the manner in which they are used, as well as contributes to making it difficult for a law enforcement professional to rapidly find items that are needed. Another such reason is that the passenger location on the front seat of a law enforcement vehicle that these organizers currently utilize is often needed when a law enforcement professional that is training another officer who is driving the vehicle or is needed for transporting a civilian. This necessitates the in-car organizer to be removed from the front seat and placed either in the back seat (e.g., often used for transporting prisoners) or in the trunk (i.e., a cargo space) where it is not designed to be used/secured). This dramatically reduces the usefulness of the organizer due to reasons such as the organizer and its contents being tossed around by movement of the vehicle and/or other items being place in and/or on top of the organizer. Still another such reason is that there is not a standardized in-car organizer and the manner in which in-car organizers are stocked will vary from person-to-person. This contributes to making it difficult for a law enforcement professional to readily find items that are needed when seeking items in a car that is not their own (e.g., during a stand-off confrontation where a law enforcement professional has taken cover behind a vehicle of another law enforcement professional).

Another type of existing organizer is one that is mounted to the bottom of the trunk (e.g., in the form of a plastic bin that sit on the floor of the trunk), which results in loss of trunk space. These types of trunk floor located organizers invariably end up with other articles being stored on top of the organizer. This is highly inefficient if an officer has to unload their trunk just to gain access to the articles in the organizer. Also, these types of organizers are susceptible to undesired shifting during movement of the vehicle when not fixedly mounted in place (which is often the case). Due to the hard working nature of a law enforcement professional's vehicle, it is common for contents in the trunk to shift or even be turned over. In life threatening situations or in times when bodily injury is occurring or is imminent, a law enforcement professional has to respond to such situations quickly, which requires taking curves as fast as possible, decelerating and accelerating at extremes, and sometimes causing their vehicles to leave the ground. In the daily use of an unsecured organizer in the trunk of the vehicle, it is a waste of valuable time to have to reorganize articles in an organizer that have become disorganized due to the organizer having flipped over or shifted during vehicle use.

'Go Bags' are also very common with law enforcement professionals. A 'Go Bag' is basically a self made bag by each individual law enforcement professional containing what a particular law enforcement professional thinks is vital to their survival and the survival of their peers in case of a critical or life-threatening situation. The typical Go Bag contains supplies such as extra ammunition and severe trauma related medical supplies. The problem with this concept is that each bag is different depending on the way the officer makes and organizes it. There are several different options for bags out there and no two brands are exactly alike. The other problem with this is that a bag can be stored anywhere in a vehicle (e.g., in the cabin or in the trunk). In high stress and life threatening situations, seconds count, which means there is no time to dig or sift through someone else's vehicle to find what you need to save a life.

During day-to-day operations, the trunk of a law enforcement vehicle can become cluttered and disorganized. As previously noted, law enforcement professionals are frequently confronted with high speed driving, including quick acceleration and braking and taking curves very quickly. During these movements, a Go Bag can become lost in the cabin or trunk and not readily available when it is needed the most. A Go Bag can be kept on the front passenger seat of the vehicle or in the trunk. However, an ability to immediately locate a Go Bag can be compromised when it is moved from a preferred location (e.g., on the front seat) to make room for a fellow officer or civilian.

Undesirably, when a law enforcement professional does not have a means for organizing their equipment, it can readily become scattered throughout the passenger cabin and/or trunk of their vehicle. Therefore, an organizer that can be securely mounted at a location in a cargo space (e.g., trunk) of a vehicle in a manner allowing ready access to known location of articles stored therein would be advantageous, desirable and useful. Additionally this space is currently unutilized by any other equipment or organizer.

SUMMARY OF THE DISCLOSURE

Embodiments of the present invention are directed to an organizer that can be securely mounted at a location in a cargo space (e.g., trunk) of a vehicle in a manner allowing ready access to a known location of articles stored therein. More specifically, embodiments of the present invention are directed to a trunk lid mounted organizer specifically configured for articles used by law enforcement professionals in situations where access to needed items is of critical importance (i.e., a multi-use urgent response resource kit—MURRK). In preferred embodiments, an organizer configured in accordance with the present invention has dedicated spaces for urgent response articles such as ammunition, deterrent sprays, and medical supplies thereby making them easily and readily accessible. Although an organizer configured in accordance with the present invention is configured for holding articles commonly used in urgent response situations, it can also be configured with a dedicated space for holding articles such as forms, paperwork, and citations.

Advantageously, use of an organizer configured in accordance with the present invention makes articles therein readily accessible to a law enforcement professional in their own vehicle. Furthermore, if such an organizer is used by an entire law enforcement department or several law enforcement departments in any given area, every law enforcement professional in the department(s)/area knows where to find needed articles in each vehicle.

In one embodiment of the present invention, an organizer assembly comprises an article holding body and a mounting structure. The article holding body has opposing major faces. An ammunition magazine holding structure, a shotgun shell holding structure and an article containment pocket are provided on a first one of the opposing major faces. The mounting structure is attached to the article holding body on a second one of the opposing major faces.

In another embodiment of the present invention, an organizer assembly comprises an article holding body and a mounting structure. The article holding body has a first body segment, a second body segment and a hinge segment connected between the first body segment and the second body segment. The first body segment, the second body segment and the hinge segment jointly define opposing major faces of the article holding body. An ammunition magazine holding structure, a shotgun shell holding structure, an article containment pocket and a canister holding structure are provided on a first one of the opposing major faces. The mounting structure is selectively attachable to and detachable from the first body segment at a second one of the opposing major faces.

In another embodiment of the present invention, an organizer assembly comprises an article holding body and a mounting structure. The article holding body has a first body segment, a second body segment and a hinge segment connected between the first body segment and the second body segment. The first body segment, the second body segment and the hinge segment jointly define opposing major faces of the article holding body. A plurality of ammunition magazine holding structure of a first configuration, a plurality of ammunition magazine holding structure of a second configuration, a plurality of shotgun shell holding structures, a plurality of article containment pockets and a canister holding structure are provided on a first one of the opposing major faces. At least one of the shotgun shell holding structures is selectively detachable from and re-attachable to the article holding body. The mounting structure is selectively attachable to and detachable from the first body segment at a second one of the opposing major faces.

These and other objects, embodiments, advantages and/or distinctions of the present invention will become readily apparent upon further review of the following specification, associated drawings and appended claims.

DETAILED DESCRIPTION

Figure 1:
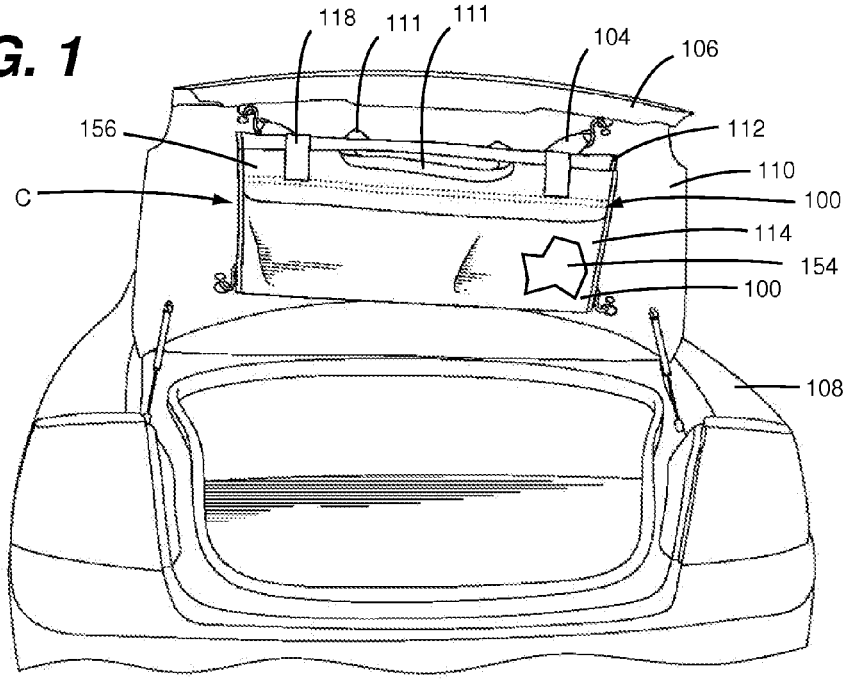
FIG. 1 is an illustrative perspective view showing an organizer assembly configured in accordance with an embodiment of the present invention mounted in a closed configuration on a trunk lid of a vehicle.
Figure 2:
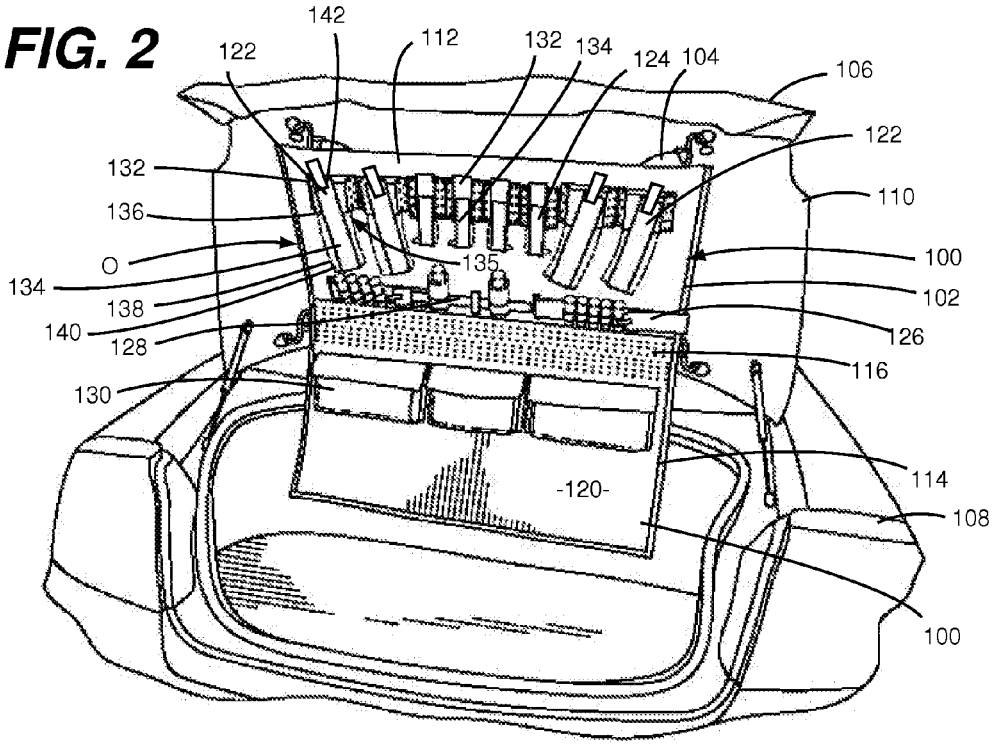
FIG. 2 is an illustrative perspective view showing the organizer assembly shown in FIG. 1 mounted in an open configuration on the trunk lid of the vehicle.

FIGS. 1 and 2 show an organizer assembly 100 configured in accordance with an embodiment of the present invention. The organizer assembly 100 includes an article holding body 102 and a mounting structure 104 attached to the article holding body 102. The mounting structure 104 is configured for being engaged with a trunk lid 106 (i.e., an access opening cover) of a vehicle 108 such that it is generally flush against an interior surface 110 of the trunk lid 106. As discussed below in greater detail, the article holding body 102 can be attached to the mounting structure 104 in a manner allowing the article holding body 102 to be detached from and reattached to the mounting structure 104 while the mounting structure 104 remains attached to the trunk lid 106 of the vehicle 108. In this manner, the article holding body 102 can be readily accessible and mobile if it needs to be taken from the vehicle 108 (e.g., to a scene of an incident, to a different vehicle, use as a range bag, etc). To this end, the article holding body 102 can include one or more carry handles 111.

As shown, the article holding body 102 has a first body segment 112 that is connected to a second body segment 114 through a hinge segment 116 (i.e., a bi-fold construction). The first body segment 112 is attached to the mounting structure 104 in a manner allowing the article holding body 102 to be detached from and reattached to the mounting structure 104. Preferably, but not necessarily, the first body segment 112, the second body segment 114 and the hinge segment 116 are each made from a durable material that is water resistant and stretch resistant (e.g., industrial grade woven nylon fabric).

While attached to the mounting structure 104 with the mounting structure 104 attached to the trunk lid 106, the article holding body 102 can be in an open configuration O (shown in FIG. 2) or secured in a closed configuration C (shown in FIG. 1) via a article body closure structure such as straps 118. When in the open configuration O, articles at an interior face 120 (i.e., a first major face thereof) of the article holding body 102 (i.e., defined by interior faces of the first body segment 112, the second body segment 114 and the hinge segment 116) are readily accessible. When in the closed configuration C, such articles are concealed within an interior space jointly defined by the first body segment 112, the second body segment 114 and the hinge segment 116. In this regard, the bi-fold construction of the article holding body 102 beneficially provides space savings in that, when the article holding body 102 is in the closed configuration C, it occupies space that was previously not utilized.

The segmented construction of the article holding body 102 allows the article holding body 102 to transition from the closed configuration C to the open configuration O through the force of gravity as a result of the straps 118 being released (i.e., gravity operated transitioning from the closed configuration C to the open configuration O). More specifically, the weight of the second body segment 114 causes the second body segment 114 to swing away from the first body segment 112 about the hinge segment 116 to a position corresponding to the article holding body 102 being in the open configuration O. This is beneficial in that it reduces the degree of operator dexterity required for transitioning the article holding body 102 from the closed configuration C to the open configuration O. For example, when an individual is placed in an intense stressful situation, dexterity and motor functions suffer drastically. The gravity-operated nature of the article holding body 102 when attached to the mounting structure 104 counteracts this issue.

The organizer assembly 100 alleviates the aforementioned problems of conventional organizers by having vital equipment such as ammunition and medical supplies in a previously unused and readily accessible location in a vehicle. To this end, the organizer assembly 100 keeps all articles contained therein secured to the trunk lid 106. Furthermore, the organizer assembly 100 can be located in a common location in most vehicles used by law enforcement professionals such that a law enforcement professional knows where essential equipment may be located in a vehicle even if it is not their own vehicle. Having consistency in location of essential articles is extremely important for geographic situations where several different law enforcement departments/agencies work together on a regular basis and would prove beneficial as a standard on an impromptu basis.

Figure 3:
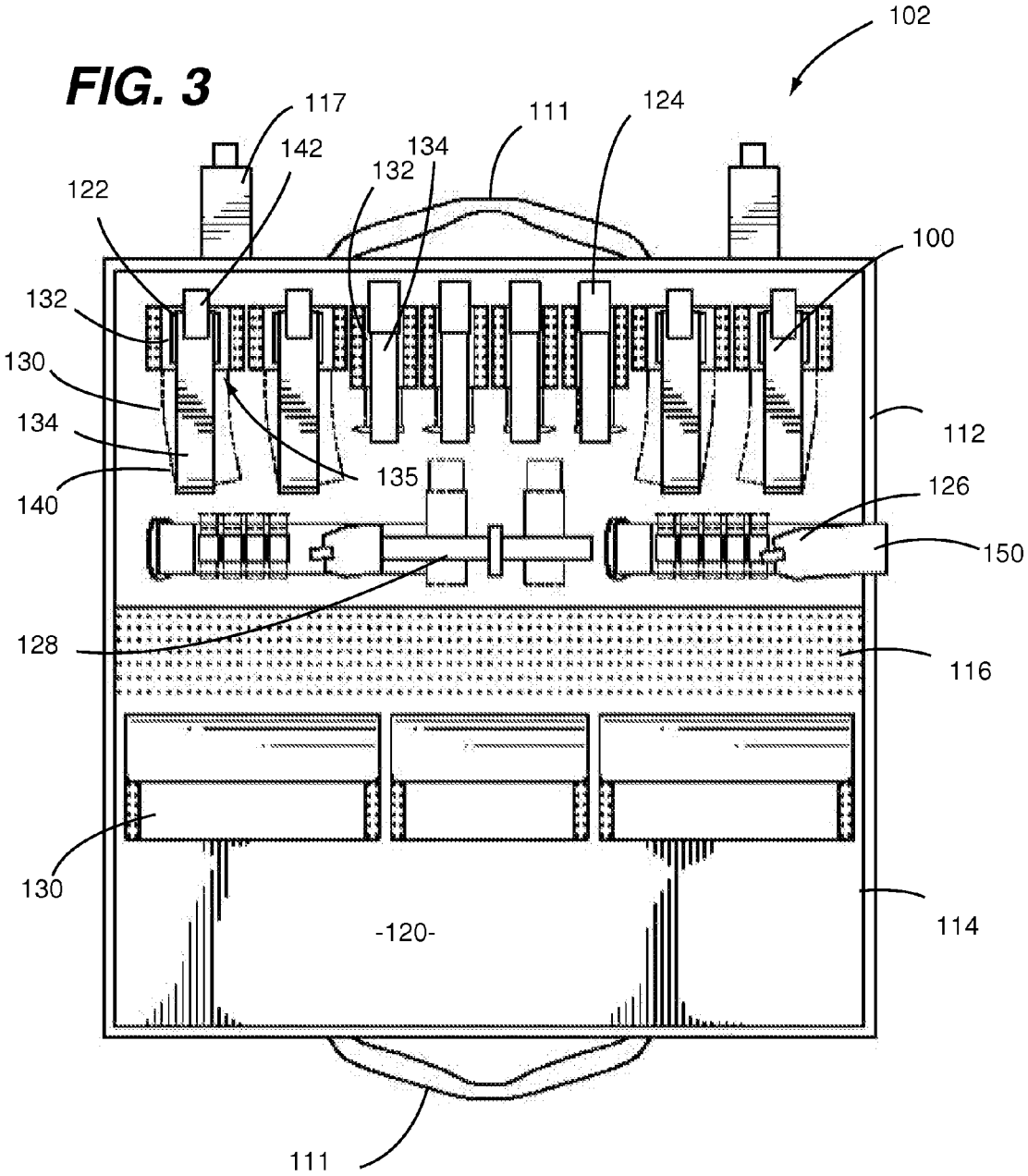
FIG. 3 is an illustrative plan view showing an interior face of an article holding body of the organizer assembly shown in FIG. 1.
Figure 4:
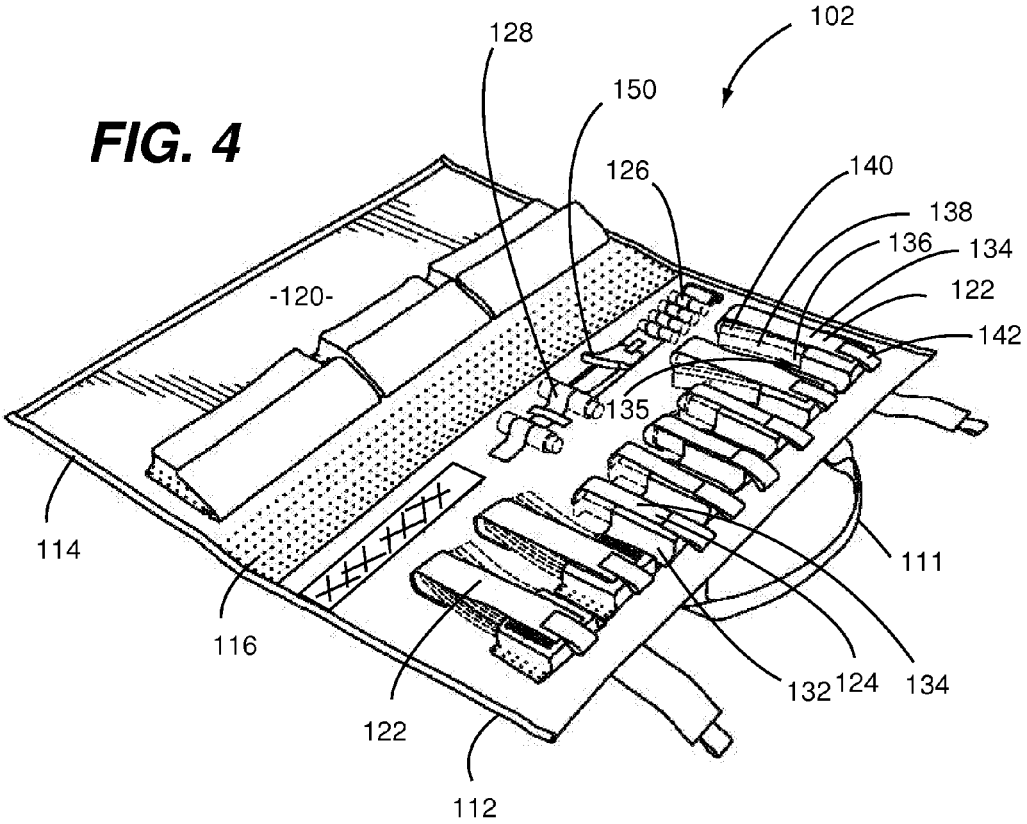
FIG. 4 is an illustrative perspective view showing the interior face of the article holding body of the organizer assembly shown in FIG. 1 with a shotgun shell holding structure thereof detached therefrom.

Turning now to FIGS. 2-4, various details of article containment functionality of the article holding body 102 are shown. On the interior face 120 of the article holding body 102, the article holding body 102 includes a plurality of rifle ammunition magazine holding structures 122 (i.e., first configuration article holding structures), a plurality of handgun ammunition magazine holding structures 124 (i.e., second configuration article holding structures), a plurality of shotgun shell holding structures 126, a canister holding structure 128 (e.g., an elastic strap with discrete canister holding portions) and a plurality of article containment pockets 130. The ammunition magazine holding structures 122, 124, the shotgun shell holding structures 126 and the canister holding structure 128 are attached to the first body segment 112 of the article holding body 102 and the article containment pockets 130 is attached to the second body segment 114 of the article holding body 102. The shotgun shell holding structures 126 and the canister holding structure 128 are located below the ammunition magazine holding structures 122, 124. The canister holding structure 128 is located between the shotgun shell holding structures 126. In view of the disclosures made herein, a skilled person will appreciate that article holding bodies configured in accordance with the present invention are not unnecessarily limited to a particular configuration, type, placement, and/or quantity of article containment structure (e.g., ammunition magazine holding structures, shotgun shell holding structures, canister holding structures, article containment pockets, and the like).

Each one of the ammunition magazine holding structures 122, 124 includes an ammunition magazine receiving pocket 132 and a magazine retaining strap 134. As best shown in FIG. 2, the ammunition magazine receiving pocket 132 of a particular one of the ammunition magazine holding structures 122, 124 has an open end portion 135 for receiving a first end portion 136 of an ammunition magazine 138 contained therein. The magazine retaining strap 134 of the particular one of the ammunition magazine holding structures 122, 124 has a first end portion thereof attached to the interior face 120 of the article holding body 102, extends around a second end portion 140 of the ammunition magazine 138 and is engaged at a second end portion thereof with ammunition magazine receiving pocket 132 (e.g., via hook and loop fastener) for securing the ammunition magazine in place within the particular one of the ammunition magazine holding structures 122, 124. A looped material portion 142 can be provided at the second end portion of each one of the magazine retaining straps 134 for making it easier to grasp the second end portion of a particular one of the magazine retaining strap 134 (e.g., during times of high stress when fine motor movements in an officer's hands may be reduced).

As shown, the ammunition magazine holding structures 122, 124 are oriented (i.e., open end portion 135 downward facing) such that they are in a "gravity drop" configuration for causing the ammunition magazine 138 contained therein to drop from the ammunition magazine receiving pocket 132 when the magazine retaining strap 134 is detached from the ammunition magazine receiving pocket 132. Alternatively, all or a portion of the ammunition magazine holding structures 122, 124 can be oriented (i.e., open end portion 135 upward facing) such that they are in a "gravity held" configuration such that ammunition magazine 138 contained therein will remain within the ammunition magazine receiving pocket 132 when the magazine retaining strap 134 is detached from the ammunition magazine receiving pocket 132. It is disclosed herein that each ammunition magazine holding structure 122, 124 is an example of a strap and cup type article holding structure.

Figure 5:
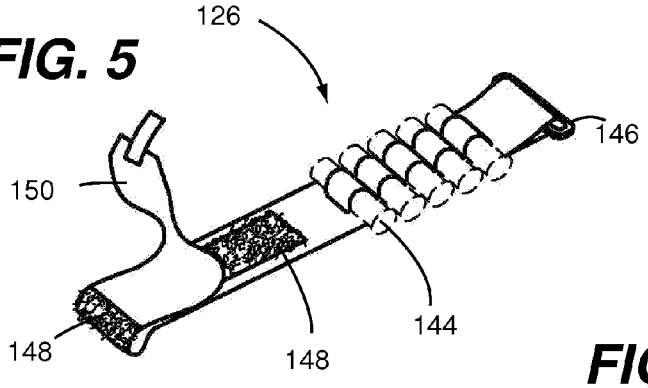
FIG. 5 is an illustrative perspective view showing the shotgun shell holding structure shown in FIG. 4.
Figure 6:
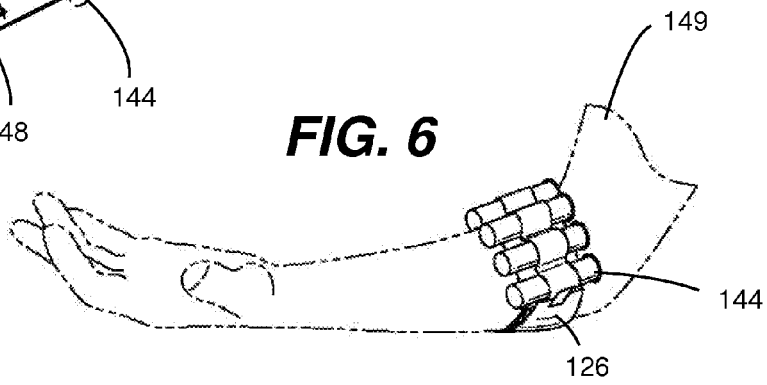
FIG. 6 is an illustrative perspective view showing the shotgun shell holding structure shown in FIG. 4 mounted on the arm of a person.

Each one of the shotgun shell holding structures 126 can hold a plurality of shotgun shells 144. For example, each shotgun shell holding structure 126 can have an elastic strap with discrete shell holding portions. As shown in FIG. 5, each shotgun shell holding structure 126 can be configured to be selectively detached from and re-attached to the interior face 120 of the article holding body 102 such as through hook and loop fastener. In this manner, each shotgun shell holding structure 126 can be in the form of a strap having a ring 146 at a first end portion thereof and a securing means 148 (e.g., hook and loop fastener, mechanical snap(s), magnet(s), etc) at a second end portion thereof that jointly allow the shotgun shell holding structure 126 to be secured around an arm 149 of a person (FIG. 6). Similar to the magazine retaining strap 134 of each one of the ammunition magazine holding structures 122, 124, a looped material portion 150 can be provided at the second end portion of each one of the shotgun shell holding structures 126 for making it easier to grasp the second end portion of a particular one of the shotgun shell holding structures 126 to allow release from the interior face 120 of the article holding body 102 and/or from the person's arm. It is disclosed herein that each shotgun shell holding structure 126 is an example of a detachable article holding structure that can be in the form of a strap with integral securing portions for allowing the strap to be secured around a portion of a remote structure (e.g., an appendage of a person).

The article containment pockets 130 each have a closure means 152 (e.g., a flap, zipper, snap(s), hook and loop, etc) for containing articles (e.g., medical supplies, ammunition, tools, etc) within an interior space thereof. As shown, the article containment pockets 130 can be in a side-by-side arrangement with respect to each other and/or can be in an over/under arrangement. In view of the disclosures made herein, a skilled person will appreciate that article holding bodies configured in accordance with the present invention are not unnecessarily limited to a particular configuration, type, placement, and/or quantity of article containment pockets 130. Furthermore, it is disclosed herein that one or more of the article containment pockets 130 can a standalone structure that can be detachable secured to the interior face 120 of the article holding body 102 by an adjoining means 160 such as hook-type fastening material and loop-type fastening material (e.g., offered under the trademark Velcro). For example, to provide for selective detachment from and re-attachment to of a particular one of the article containment pockets 130 from the interior face 120 of the article holding body 102, one of the fastening materials types can be provided on a rear face of the particular one of the article containment pockets 130 and the other type can be provided on the interior face 120 of the article holding body 102.

Figure 7:
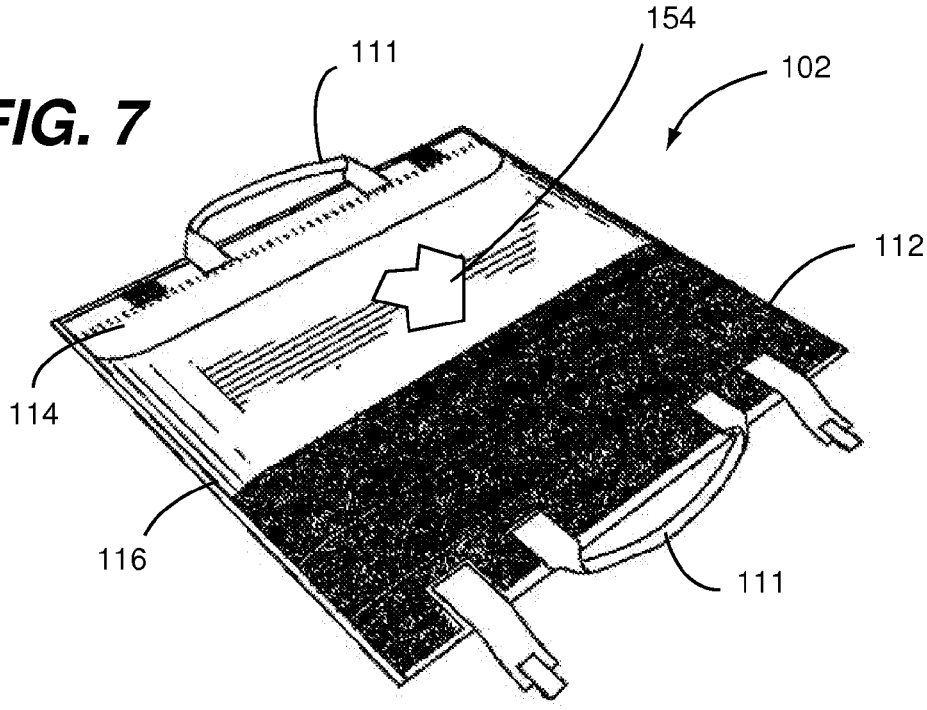
FIG. 7 is an illustrative perspective view showing an exterior face of the article holding body of the organizer assembly shown in FIG. 1.

Referring to FIGS. 1 and 7, the article holding body 102 has an article storage space 154 (shown in fragmentary form) within the second body segment 114 in which articles such as, for examples, clipboards, legal pads, ticket books, hazard signage, and the like can be stored. The article storage space 154 is accessible through an opening under a closure flap 156. The closure flap 156 and second body segment 114 of the article holding body 102 can jointly include a securing means (e.g., hook and loop fastener, mechanical snap(s), magnet(s), etc) for allowing the closure flap 156 to be secured in a closed position over the opening under the closure flap 156. The closure flat extends partially over an exterior face 155 (i.e., a second major face thereof) of the article holding body 102 (i.e., defined by exterior faces of the first body segment 112, the second body segment 114 and the hinge segment 116). In this manner, the article storage space 154 is within the second body segment 114 between the interior face 138 and the exterior face 155.

Figure 8:
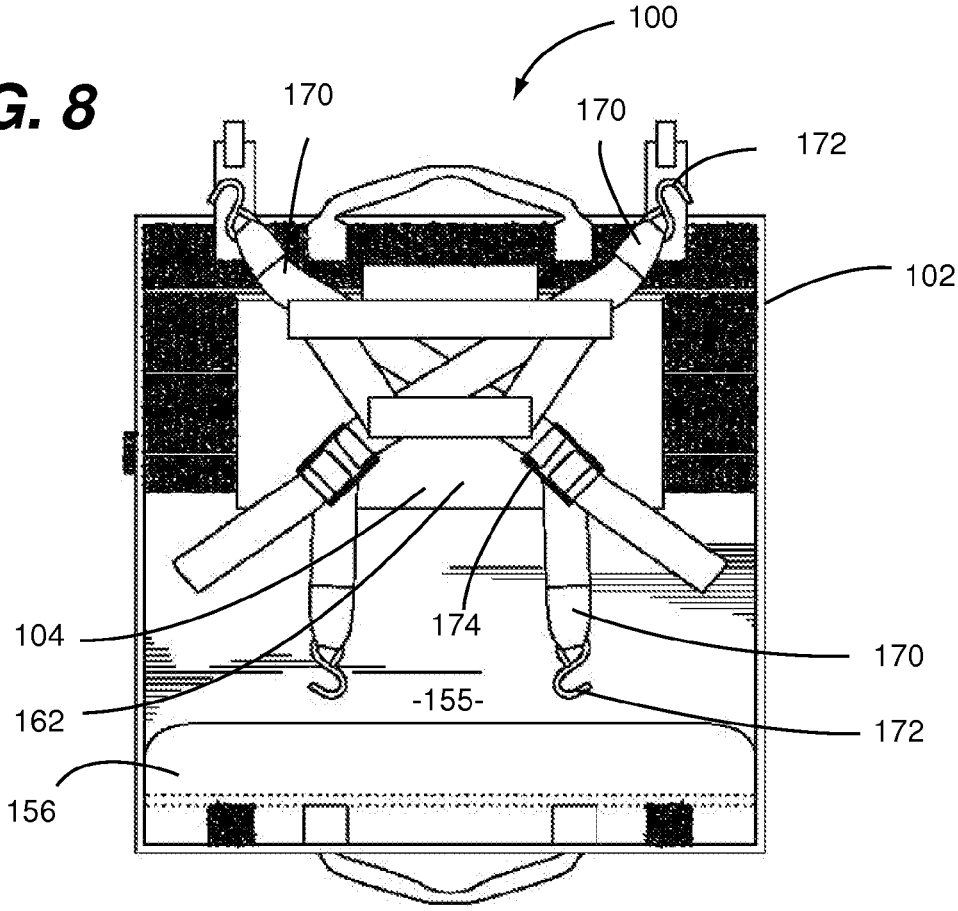
FIG. 8 is an illustrative perspective view showing the exterior face of the article holding body of the organizer assembly shown in FIG. 1 with a mounting attached thereto.
Figure 9:
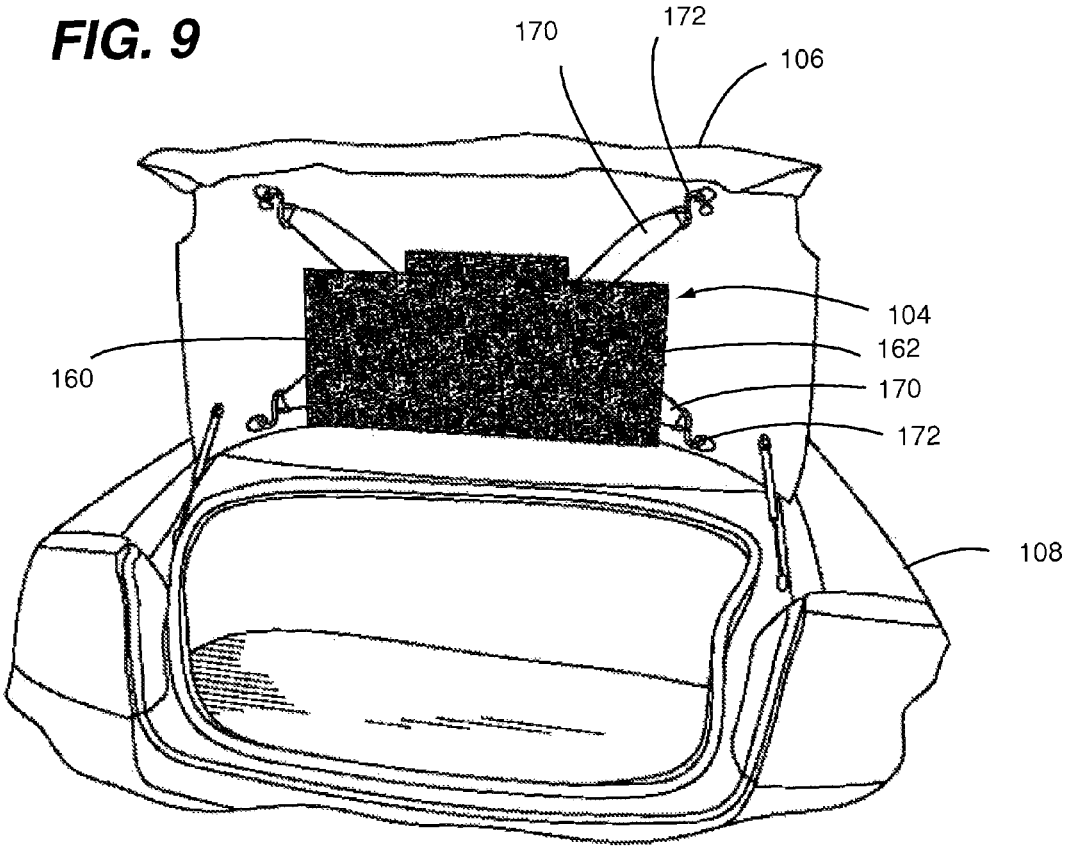
FIG. 9 is an illustrative perspective view showing the mounting structure mounted on a trunk lid of a vehicle.

Referring to FIGS. 8 and 9, the article holding body 102 and the mounting structure 104 jointly include adjoining means 160 that allows the article holding body 102 to be selectively detached from and reattached to the mounting structure 104 while the mounting structure 104 remains attached to the trunk lid 106 of the vehicle 108. One example of such an adjoining means 160 is hook-type fastening material and loop-type fastening material (e.g., offered under the trademark Velcro). To provide for selective detachment of the article holding body 102 from the mounting structure 104, one of the fastening materials types can be provided on a rear face of the article holding body 102 and the other type can be provided on an engagement body 162 of the mounting structure 104. In this manner, the hook-type fastening material and loop-type fastening allows the article holding body 102 to be detached from and reattached to the engagement pad of the mounting structure 104 while the mounting structure 104 remains attached to the trunk lid 106 of the vehicle 108. It is disclosed herein that embodiments of the present invention are not unnecessarily limited to any particular type or configuration of adjoining means. For example, an adjoining means comprising magnets, snaps, clips or the lip can be used for allowing the article holding body 102 to be detached from and reattached to the mounting structure 104.

Still referring to FIGS. 8 and 9, it can be seen that the mounting structure 104 of the organizer assembly 100 is secured to the trunk lid 106 of the vehicle 108 through a plurality of straps 170 and hooks 172. A first end portion of each one of the straps is attached to the engagement body 162 of the mounting structure 104 and a second end portion of each one of the straps is attached to one of the hooks 172. The hooks engage openings or other engagement feature(s) of the trunk lid 106 and some or all of the straps 170 include an adjustment means 174 (e.g., friction lock buckles) for allowing a length of a corresponding one of the straps 170 to be adjusted. Through such adjustment, the mounting structure 104 of the organizer assembly 100 can be a generally universal fitment to almost any vehicle with a trunk lid or other suitable the access opening cover (e.g., a SUV cargo space door).

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. An organizer assembly, comprising: an article holding body having opposing major faces, wherein an ammunition magazine holding structure, a shotgun shell holding structure and an article containment pocket are provided on a first one of the opposing major faces, wherein the ammunition magazine holding structure includes an ammunition magazine receiving pocket and a magazine retaining strap, wherein a first end portion of the magazine retaining strap is attached to the first one of the opposing major faces of the article holding body at a location spaced away from an open end portion of the ammunition magazine receiving pocket and wherein a second end portion of the magazine retaining strap is releasably attached to an exterior surface of the ammunition magazine receiving pocket; and a mounting structure attached to the article holding body on a second one of the opposing major faces, wherein the mounting structure including an engagement body and a plurality of retention straps each attached at a first end portion thereof to the engagement body, and wherein the article holding body is selectively attachable to and detachable from the engagement body through a connection structure having a first part thereof fixedly attached to the engagement body and a second part thereof fixedly attached to a second one of the opposing major faces of the article holding body.

2. The organizer assembly of claim 1 wherein: the shotgun shell holding structure includes a main body having a rear face thereof engaged with the first one of the opposing major faces and a plurality of shell holding receptacles exposed at a front face thereof; and the main body of the shotgun shell holding structure is selectively detachable from and re-attachable to the article holding body.

3. The organizer assembly of claim 2 wherein the main body of shotgun shell holding structure includes opposing end portions thereof configured for being secured around a portion of a person.

4. The organizer assembly of claim 1 wherein the article containment pocket is selectively detachable from and re-attachable to the article holding body.

5. The organizer assembly of claim 1 wherein the article containment pocket is detachable from and re-attachable to the article holding body.

6. The organizer assembly of claim 1 wherein the a central portion of the magazine retaining strap overlies the first end portion of the magazine retaining strap when the second end portion of the magazine retaining strap is attached to the ammunition magazine receiving pocket.

7. The organizer assembly of claim 1 wherein: the article holding body includes a first body segment, a second body segment and a hinge segment connected between the first body segment and the second body segment; and the mounting structure is attached to the first body segment; the ammunition magazine holding structure and the shotgun shell holding structure are attached to the first body segment.

8. The organizer assembly of claim 7 wherein: the shotgun shell holding structure includes a main body having a rear face thereof engaged with the first one of the opposing major faces and a plurality of shell holding receptacles exposed at a front face thereof; and the main body of the shotgun shell holding structure is selectively detachable from and re-attachable to the article holding body.

9. The organizer assembly of claim 8 wherein the main body of shotgun shell holding structure includes opposing end portions thereof configured for being secured around a portion of a person.

10. The organizer assembly of claim 8 wherein the a central portion of the magazine retaining strap overlies the first end portion of the magazine retaining strap when the second end portion of the magazine retaining strap is attached to the ammunition magazine receiving pocket.

11. An organizer assembly, comprising:

an article holding body having a first body segment, a second body segment and a hinge segment connected between the first body segment and the second body segment, wherein the first body segment, the second body segment and the hinge segment jointly define opposing major faces of the article holding body, wherein an ammunition magazine holding structure, a shotgun shell holding structure, an article containment pocket and a canister holding structure are provided on a first one of the opposing major faces, wherein the ammunition magazine holding structure includes an ammunition magazine receiving pocket and a magazine retaining strap, wherein a first end portion of the magazine retaining strap is attached the first one of the opposing major faces at a location spaced away from an open end portion of the ammunition magazine receiving pocket and wherein a second end portion of the magazine retaining strap is releasably attached to an exterior surface of the ammunition magazine receiving pocket; and a mounting structure including an engagement body and a plurality of retention members each attached at a first end portion thereof to the engagement body, wherein the article holding body is selectively attachable to and detachable from the engagement body through a connection structure having a first part thereof fixedly attached to the engagement body and a second part thereof fixedly attached to a second one of the opposing major faces of the article holding body at the first body segment thereof.

12. The organizer assembly of claim 11 wherein:

the shotgun shell holding structure includes a main body having a rear face thereof engaged with the first one of the opposing major faces and a plurality of shell holding receptacles exposed at a front face thereof; and the main body of the shotgun shell holding structure is selectively detachable from and re-attachable to the article holding body.

13. The organizer assembly of claim 12 wherein the main body of shotgun shell holding structure includes opposing end portions thereof configured for being secured around a portion of a person.

14. The organizer assembly of claim 11 wherein the article containment pocket is selectively detachable from and re-attachable to the article holding body.

15. The organizer assembly of claim 11 wherein the a central portion of the magazine retaining strap overlies the first end portion of the magazine retaining strap when the second end portion of the magazine retaining strap is attached to the ammunition magazine receiving pocket.

16. An organizer assembly, comprising:

an article holding body having a first body segment, a second body segment and a hinge segment connected between the first body segment and the second body segment, wherein the first body segment, the second body segment and the hinge segment jointly define opposing major faces of the article holding body, wherein a plurality of ammunition magazine holding structures of a first configuration, a plurality of ammunition magazine holding structures of a second configuration, a plurality of shotgun shell holding structures, a plurality of article containment pockets and a canister holding structure are provided on a first one of the opposing major faces, wherein an open end portion of each one of the ammunition magazine receiving pockets and an open end portion of each one of the article containment pockets face opposing directions from each other, wherein each one of the ammunition magazine holding structures includes a magazine retaining strap having an end portion thereof releasable attached to an exterior surface of the magazine receiving pocket thereof, wherein at least one of the shotgun shell holding structures includes a main body having a rear face selectively detachable from and re-attachable to the first one of the opposing major faces and a plurality of shell holding receptacles exposed at a front face thereof; and wherein at least one of the shotgun shell holding structures is selectively detachable from and re-attachable to the article holding body; and a mounting structure including an engagement body and a plurality of retention members each attached at a first end portion thereof to the engagement body, wherein the article holding body is selectively attachable to and detachable from the engagement body through a connection structure having a first part thereof fixedly attached to the engagement body and a second part thereof fixedly attached to a second one of the opposing major faces of the article holding body at the first body segment thereof.

17. The organizer assembly of claim 16 wherein the main body of each one of the shotgun shell holding structure includes opposing end portions thereof configured for being secured around a portion of a person.

18. The organizer assembly of claim 16 wherein:

each one of the ammunition magazine holding structures includes an ammunition magazine receiving pocket and a magazine retaining strap jointly arranged in a gravity drop configuration; and a first end portion of the magazine retaining strap of each one of the ammunition magazine holding structures is attached to a surface of the first one of the opposing major faces at a location spaced away from the open end portion of the ammunition magazine receiving pocket thereof; and a second end portion of the magazine retaining strap of each one of the ammunition magazine holding structures is releasably attached to the exterior surface of the ammunition magazine receiving pocket thereof.

* * * * *